US009334883B2

(12) United States Patent
Vigholm et al.

(10) Patent No.: US 9,334,883 B2
(45) Date of Patent: May 10, 2016

(54) METHOD FOR CONTROLLING A HYDRAULIC SYSTEM OF A WORKING MACHINE

(75) Inventors: Bo Vigholm, Stora Sundby (SE); Jan Karlsson, Eskilstuna (SE); Andreas Ekvall, Hallstahammar (SE); Kim Heybroek, Strängnäs (SE)

(73) Assignee: Volvo Construction Equipment AB, Eskilstuna (SE)

( * ) Notice: Subject to any disclaimer, the term of this patent is extended or adjusted under 35 U.S.C. 154(b) by 417 days.

(21) Appl. No.: 13/881,759

(22) PCT Filed: Nov. 1, 2010

(86) PCT No.: PCT/SE2010/000264
§ 371 (c)(1),
(2), (4) Date: Apr. 26, 2013

(87) PCT Pub. No.: WO2012/060742
PCT Pub. Date: May 10, 2012

(65) Prior Publication Data
US 2013/0205765 A1 Aug. 15, 2013

(51) Int. Cl.
*F15B 15/18* (2006.01)
*E02F 9/22* (2006.01)
*F15B 11/16* (2006.01)

(52) U.S. Cl.
CPC ..... *F15B 15/18* (2013.01); *E02F 9/2235* (2013.01); *E02F 9/2296* (2013.01);
(Continued)

(58) Field of Classification Search
CPC ..... F15B 11/165; E02F 9/2235; E02F 9/2296
USPC ..... 60/422, 452
See application file for complete search history.

(56) References Cited

U.S. PATENT DOCUMENTS 5,347,811 A 9/1994 Hasegawa et al.
5,434,785 A 7/1995 Myeong-Huen et al.
(Continued)

FOREIGN PATENT DOCUMENTS

JP 2774552 B2 * 7/1998

OTHER PUBLICATIONS

JP 2240402 A (Hitachi Construction Machinery), Sep. 25, 1990; (abstract) Original document: figures: English machine produced translation of JP 2774552 B2 retrieved from http://aipn1.ipdl.inpit.go.jp.
(Continued)

*Primary Examiner* — Thomas E Lazo
(74) *Attorney, Agent, or Firm* — WRB-IP LLP

(57) ABSTRACT

A method is provided for controlling a hydraulic system of a working machine. The hydraulic system includes a hydraulic machine for providing hydraulic fluid to one or more actuators of the working machine. The method includes receiving a signal requesting a pump pressure from the hydraulic machine based on the load pressure of a first actuator of the one or more actuators which first actuator has the highest load pressure of the one or more actuators, discriminating the pressure request from the first actuator provided that the first actuator is stalled due to overload or geometrical limitations, and controlling the hydraulic machine to provide a pump pressure based on the load pressure of a second actuator of the one or more actuators which second actuator is in operation and has the second highest load pressure of the one or more actuators, or, if no actuator in addition to the first actuator is present and in operation, controlling the hydraulic machine to provide a predetermined idle pump pressure.

8 Claims, 3 Drawing Sheets

(52) U.S. Cl.
CPC .... *F15B 11/165* (2013.01); *F15B 2211/20546* (2013.01); *F15B 2211/251* (2013.01); *F15B 2211/633* (2013.01); *F15B 2211/6309* (2013.01); *F15B 2211/6313* (2013.01); *F15B 2211/665* (2013.01); *F15B 2211/6652* (2013.01); *F15B 2211/6653* (2013.01); *F15B 2211/71* (2013.01); *F15B 2211/781* (2013.01); *F15B 2211/88* (2013.01)

(56) References Cited

U.S. PATENT DOCUMENTS 5,974,352 A * 10/1999 Shull ..... 701/50
7,260,931 B2 * 8/2007 Egelja et al. ..... 60/422
8,036,797 B2 * 10/2011 Johnson et al. ..... 701/50
8,483,916 B2 * 7/2013 Peterson et al. ..... 701/50
2008/0234902 A1 9/2008 Johnson et al.

OTHER PUBLICATIONS

JP 6280803 A (Hitachi Construction Machinery), Nov. 29, 1995; (abstract) Original document: figures.

International Search Report (Jul. 11, 2011) for corresponding International application No. PCT/SE2010/000264.

International Preliminary Report on Patentability (Feb. 7, 2013) for corresponding International application No. PCT/SE2010/000264.

* cited by examiner

METHOD FOR CONTROLLING A HYDRAULIC SYSTEM OF A WORKING MACHINE

BACKGROUND AND SUMMARY

The invention relates to a method for controlling a hydraulic system of a working machine.

The invention is applicable on working machines within the fields of industrial construction machines, in particular wheel loaders. Although the invention will be described hereinafter with respect to a wheel loader, the invention is not restricted to this particular machine, but may also be used in other heavy working machines, such as articulated haulers, dump trucks, graders, excavators or other construction equipment.

A working machine is provided with a bucket, container or other type of implement for digging, lifting, carrying and/or transporting a load.

For example, a wheel loader has a load arm unit for raising and lowering an implement, such as a bucket. The load arm unit comprises a number of hydraulic cylinders for movement of a load arm and the implement attached to the load arm. A pair of hydraulic cylinders is arranged for lifting the load arm and a further hydraulic cylinder is arranged for tilting the implement relative to the load arm.

In addition to the hydraulic cylinders, the hydraulic system of the wheel loader comprises at least one pump for providing hydraulic fluid to the hydraulic cylinders of the load arm unit.

The hydraulic system of a wheel loader is usually a so called load sensing system (LS system). This means that the pump which provides the hydraulic system with hydraulic fluid receives a signal representing the current load pressure of a hydraulic cylinder in operation. The pump is controlled to provide a pressure which somewhat exceeds the load pressure of the hydraulic cylinder. Hereby a flow of hydraulic fluid to the current hydraulic cylinder is created.

In such a LS system energy is lost when one and the same pump is used for providing hydraulic fluid to several working functions. The working functions often require different pressures, which in turn implies that the pump has to be controlled to provide the highest pressure required by any working function. If two working functions are used at the same time and these working functions have different pressure demands, the pressure has to be reduced for the working function which requires the lowest pressure. By using a valve the pressure can be reduced to the desired pressure. The pressure drop over the valve results in heat energy loss.

An example of a wheel loader operation which involves loss of energy is when the wheel loader is forced into a pile of material in order to fill the bucket and take out material from the pile. During this moment the lift operation of the load arm is often stalled due to overload. The pressure in the hydraulic cylinders for lifting the load arm can be higher than the maximal pressure provided by the pump due to the fact that the propulsion force of the wheel loader retract the hydraulic cylinders. At the same time, the bucket is tilted in order to break off material from the pile and the tilt function is operated at a pressure which is lower than the pressure requested by the lifting function. The flow of hydraulic fluid to the tilt function will result in loss of energy since the pressure of the hydraulic fluid which is provided by the pump and flows to the tilt function has to be reduced from the maximal pump pressure to the pressure level required for the tilt function.

It is desirable to provide a method defined by way of introduction, by which method the loss of energy can be reduced in a hydraulic system of a working machine.

By the provision of a method where the pressure request from the first actuator is discriminated provided that the first actuator is stalled due to overload or geometrical limitations, the pump pressure can be adapted to another actuator of the hydraulic system, which actuator requires a flow of hydraulic fluid and a lower pump pressure, instead of keeping the pump pressure at the maximal level. This implies that the pump pressure does not need to be reduced by means of a valve, and since the heat energy loss is proportional to the pressure drop over a valve multiplied with the flow through the valve the loss of energy can be eliminated or at least reduced.

Furthermore, if no actuator in addition to the stalled actuator is present and in operation (i.e. requests a flow); the hydraulic machine can be controlled to provide a predetermined idle pump pressure which is lower than the maximal pump pressure. Since a hydraulic system always has some leakages a maximal pump pressure will in addition to unnecessary load and wear lead to energy losses when the hydraulic machine is controlled to maintain the maximal pump pressure also in the case where no actuator is in operation.

The method can of course be applied for any number of actuators. For example, should both the first and second actuators having the highest and second highest pressures be stalled, the pump pressure is preferably based on the load pressure of the actuator having the highest pressure of the remaining actuators.

Further advantages and advantageous features of the invention are disclosed in the following description.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
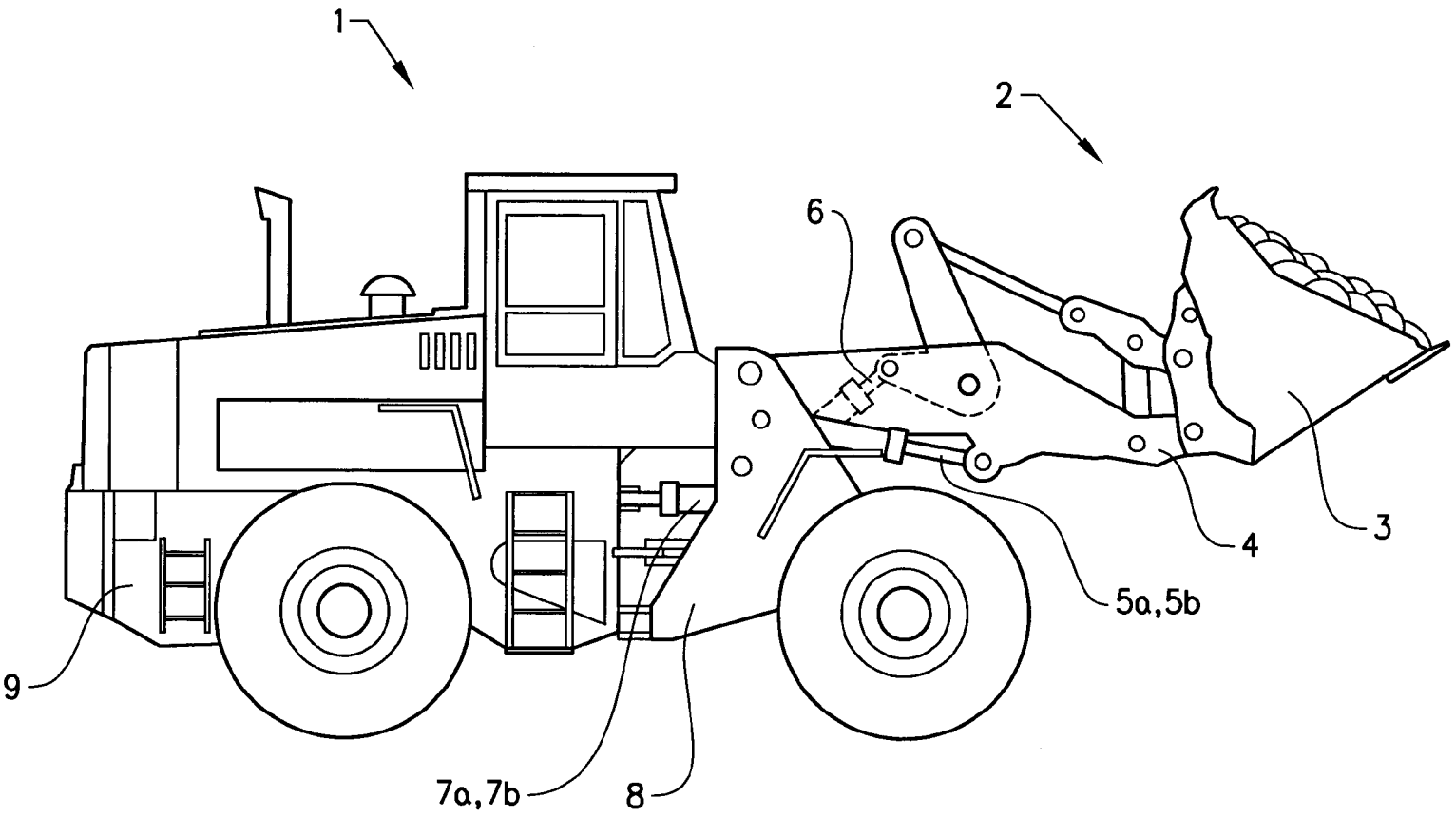
FIG. 1 is a lateral view illustrating a wheel loader having a bucket for loading operations, and a hydraulic system for operating the bucket and steering the wheel loader.

FIG. 1 is an illustration of a working machine 1 in the form of a wheel loader having an implement 2. The term "implement" is intended to comprise any kind of tool using hydraulics, such as a bucket, a fork or a gripping tool arranged on a wheel loader, or a container arranged on an articulated hauler. The implement illustrated is a bucket 3 which is arranged on an arm unit 4 for lifting and lowering the bucket 3, and further the bucket 3 can be tilted relative to the arm unit 4. The wheel loader 1 is provided with a hydraulic system comprising at least one hydraulic machine (not shown in FIG. 1). The hydraulic machine can be a hydraulic pump, although it is preferred that the hydraulic machine can work as a hydraulic pump as well as a hydraulic motor with a reversed flow of hydraulic fluid. Such a hydraulic machine with said both functions can be used as a pump for providing the hydraulic system with hydraulic fluid, for example to lift and tilt the bucket, and as a hydraulic motor for recuperation of energy, for example during a lowering operation of the implement 2. In the example embodiment illustrated in FIG. 1 the hydraulic system comprises two hydraulic cylinders 5*a*, 5*b* for the operation of the arm unit 4 and a hydraulic cylinder 6 for tilting the bucket 3 relative to the arm unit 4. Furthermore the hydraulic system comprises two hydraulic cylinders 7*a*, 7*b* arranged on opposite sides of the wheel loader for turning the wheel loader by means of relative movement of a front body part 8 and a rear body part 9. In other words; the working machine is frame-steered by means of the steering cylinders 7*a*, 7*b*.

Figure 2:
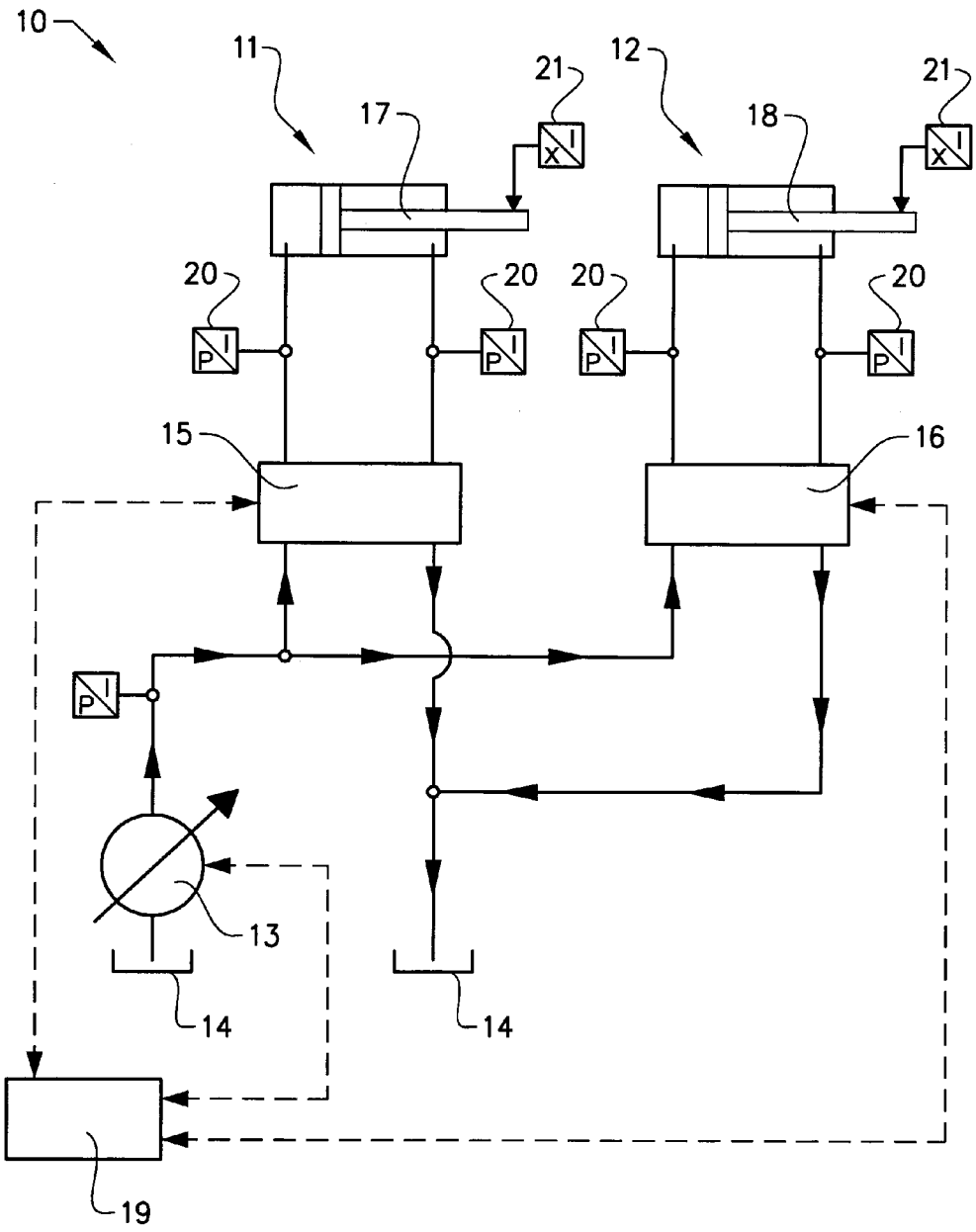
FIG. 2 is a schematic illustration of a hydraulic system to which the method according to the invention can be applied.

FIG. 2 is a schematic illustration of a hydraulic system 10. The hydraulic system 10 is an example of a system to which the method according to the invention can be applied. The system comprises a first actuator 11 for a first work function of a working machine and a second actuator 12 for a second work function of the working machine, and a hydraulic machine 13 such as a pump for providing hydraulic fluid to the actuators 11, 12. The pump can draw oil from a tank 14. The actuators 11, 12 illustrated are hydraulic cylinders, and the first actuator can be used for lifting a lifting arm of the working machine and the second actuator can be used for tilting an implement pivotally attached to the lifting arm.

Each actuator is provided with a control valve unit 15, 16 arranged between the pump 13 and the respective actuator 11, 12. The hydraulic fluid is transported from the pump 13 to the current actuator and from the actuator to the tank via the control valve units 15, 16.

Each schematically illustrated control valve unit 15, 16 can include one or several control valves for controlling the respective work function. Each hydraulic cylinder is preferably provided with a double-acting piston 17, 18, which can be pressurized on both sides. For example, a first control valve can be arranged to connect the pump to the piston side of the current hydraulic cylinder, and a second control valve can be arranged to connect the piston rod side of the current hydraulic cylinder to tank, for piston displacement in a first direction. The first control valve can further be arranged to connect the piston side of the current hydraulic cylinder to tank and the second control valve can then be arranged to connect the pump to the piston side of the hydraulic cylinder, for piston displacement in a second direction opposite to the first direction. The term hydraulic fluid in the text is intended to include hydraulic oil as well as any other fluids which possibly may occur in a hydraulic system.

The system 10 further comprises a control unit 19 which receives signals from pressure sensors 20 corresponding to the load pressure of the actuator/actuators and controls the pump 13 in order to achieve the requisite pump pressure. The control unit 19 is also connected to the first and second control valve units 15, 16 in order to control the magnitude of the flow of hydraulic fluid to and from the respective work function by means of the control valve units. In addition, the control unit 19 can receive signals from position sensors 21 indicating the position of the actuators, such as for example the piston position of a hydraulic cylinder.

The invention relates to a method for controlling a hydraulic system 10 of a working machine where the hydraulic system comprises a hydraulic machine 13 for providing hydraulic fluid to one or more actuators 11, 12 of the working machine. The method comprises the steps of receiving a signal requesting a pump pressure from the hydraulic machine based on the load pressure of a first actuator 11 of said one or more actuators which first actuator has the highest load pressure of said one or more actuators 11, 12, and discriminating the pressure request from the first actuator 11 provided that the first actuator is stalled due to overload or geometrical limitations. The method further comprises the step of controlling the hydraulic machine 13 to provide a pump pressure based on the load pressure of a second actuator 12 of said one or more actuators which second actuator is in operation and has the second highest load pressure of said one or more actuators, or, if no actuator in addition to the first actuator is present and in operation, controlling the hydraulic machine to provide a predetermined idle pump pressure. One of said one or more actuators 11 is preferably provided for lifting and lowering a lifting arm unit of the working machine. One of said one or more actuators 12 is preferably provided for tilting an implement attached to a lifting arm unit of the working machine. As previously described with reference to the system illustrated in FIG. 2 the actuators 11, 12 are preferably in the form of hydraulic cylinders and/or hydraulic motors.

Figure 3:
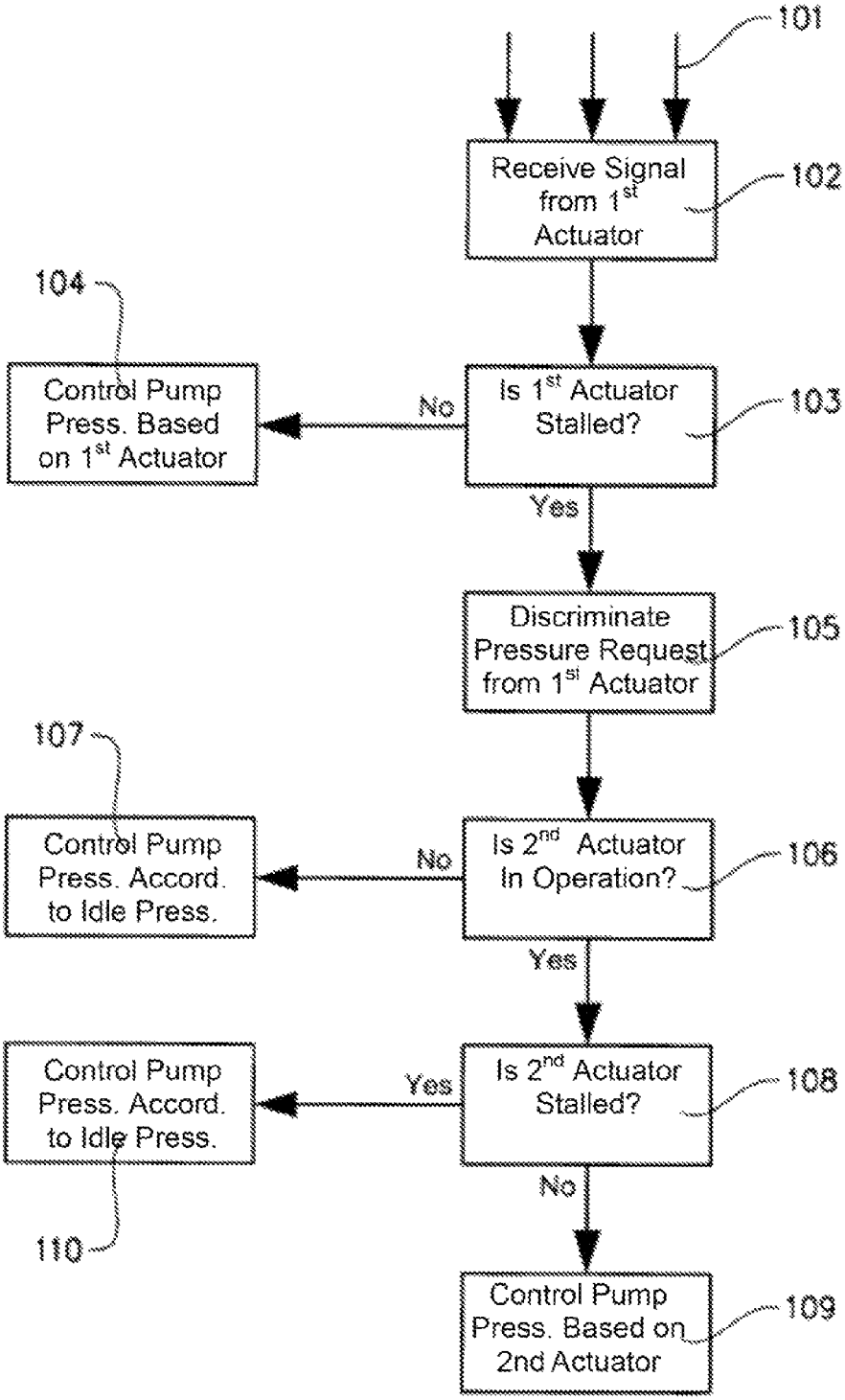
FIG. 3 is a flow chart of an example embodiment of the method according to the invention.

FIG. 3 is a flow chart where an example embodiment of the method according to the invention is illustrated. See also FIG. 2.

101. "LOAD PRESSURE SIGNALS FROM ACTUATOR/ACTUATORS". The control unit 19 can receive signals representing the load pressure of one or more actuators 11, 12.

102. "RECEIVING SIGNAL FROM A FIRST ACTUATOR HAVING THE HIGHEST LOAD PRESSURE". Normally the pump pressure is controlled by the control unit to a pump pressure which is based on the highest load pressure in order to supply the actuators with hydraulic fluid.

103. "IS THE FIRST ACTUATOR STALLED?"

If the first actuator is not stalled, then go to 104. "CONTINUE TO CONTROL THE PUMP PRESSURE BASED ON THE PRESSURE REQUESTED BY THE FIRST ACTUATOR".

If the first actuator is stalled, then go to 105. "DISCRIMINATE THE PRESSURE REQUEST FROM THE FIRST ACTUATOR". To avoid the use of a pressure level that would be unnecessary high, the pump pressure is not based on the load pressure of a stalled actuator.

106. "IS A SECOND ACTUATOR HAVING THE SECOND HIGHEST LOAD PRESSURE IN OPERATION?" If there is not any such actuator in operation, then go to 107. "CONTROL THE PUMP PRESSURE ACCORDING TO AN IDLE PRESSURE".

If there is a second actuator in operation, then go to 108. "IS THE SECOND ACTUATOR STALLED?"

If the second actuator is not stalled, then go to 109. "CONTROL THE PUMP PRESSURE BASED ON THE PRESSURE REQUESTED BY THE SECOND ACTUATOR".

If the second actuator is stalled, then go to 110. "CONTROL THE PUMP PRESSURE ACCORDING TO AN IDLE PRESSURE". Of course the number of actuators varies depending on the current hydraulic system and the method has to be modified accordingly.

The pressure request from the first actuator can be discriminated based on a predetermined load pressure value of the first actuator indicating that the first actuator is stalled. The discrimination is preferably cancelled based on a predetermined load pressure value of the first actuator indicating that the first actuator is no longer stalled.

The pressure request from the first actuator is preferably discriminated provided that the load pressure of the first actuator is above a maximal pump pressure due to a propulsion force of the working machine and/or due to a force from another of said one or more actuators. In an alternative embodiment, or in addition to a predetermined load pressure value, the request from the first actuator is discriminated based on direct or indirect measurement of the movement (or non-movement) and/or the position of the first actuator indicating that the first actuator is stalled. One way to determine the movement of the actuator is to determine the flow of hydraulic fluid to the actuator. This can be performed by measuring the hydraulic fluid pressure upstream and downstream the control valve associated with the actuator. The pressure drop over the valve can be used for calculation of the flow. A pressure drop over the valve which is zero implies that the flow is zero. If there is no flow then the actuator stands still. In an alternative embodiment the flow to the actuator is calculated by determining the current displacement adjustment utilized by the pump having a variable displacement. The displacement adjustment can be measured by means of an angle sensor arranged for indicating the position of the swashplate of the pump.

It is to be understood that the present invention is not limited to the embodiments described above and illustrated in the drawings; rather, the skilled person will recognize that many changes and modifications may be made within the scope of the appended claims.

The invention claimed is:

1. A method for controlling a hydraulic system of a working machine, the hydraulic system comprising a hydraulic machine for providing hydraulic fluid to one or more actuators of the working machine, the method comprising:

receiving a signal requesting a pump pressure from the hydraulic machine based on the load pressure of a first actuator of the one or more actuators which first actuator has the highest load pressure of the one or more actuators, discriminating the pressure request from the first actuator provided that the first actuator is stalled due to overload or geometrical limitations, and provided that the load pressure of the first actuator is above a maximal pump pressure due to a propulsion force of the working machine or due to a force from another of the one or more actuators, and controlling the hydraulic machine to provide a pump pressure based on the load pressure of a second actuator of the one or more actuators which second actuator is in operation and has the second highest load pressure of the one or more actuators, or, if no actuator in addition to the first actuator is present and in operation, controlling the hydraulic machine to provide a predetermined idle pump pressure.

2. A method according to claim 1, comprising discriminating the request from the first actuator based on direct or indirect measurement of the movement and/or the position of the first actuator indicating that the first actuator is stalled.

3. A method according to claim 1, comprising cancelling the discrimination based on a predetermined load pressure value of the first actuator indicating that the first actuator is no longer stalled.

4. A method according to claim 1, comprising providing one of the one or more actuators for lifting and lowering a lifting arm unit of the working machine.

5. A method according to claim 1, comprising providing one of the one or more actuators for tilting an implement attached to a lifting arm unit of the working machine.

6. A method according to claim 1, comprising providing the one or more actuators in the form of hydraulic cylinders and/or hydraulic motors.

7. A computer comprising code on a non-transitory medium for performing the steps of claim 1.

8. A non-transitory computer readable medium comprising a computer program stored thereon for performing the steps of claim 1.

* * * * *